US006928235B2

(12) United States Patent
Pollack

(10) Patent No.: US 6,928,235 B2
(45) Date of Patent: Aug. 9, 2005

(54) FORCED AIR DRYER FOR INFANT'S BOTTOM

(76) Inventor: Shirley Pollack, 5861 Lockwood, West Bloomfield, MI (US) 48322

( * ) Notice: Subject to any disclaimer, the term of this patent is extended or adjusted under 35 U.S.C. 154(b) by 464 days.

(21) Appl. No.: 09/939,993

(22) Filed: Aug. 27, 2001

(65) Prior Publication Data

US 2002/0006275 A1 Jan. 17, 2002

Related U.S. Application Data

(63) Continuation of application No. 09/617,641, filed on Jul. 17, 2000, now abandoned.

(60) Provisional application No. 60/173,529, filed on Dec. 29, 1999, provisional application No. 60/159,667, filed on Oct. 15, 1999, and provisional application No. 60/144,577, filed on Jul. 19, 1999.

(51) Int. Cl.[7] ..... F24H 3/00; A45D 20/00; F26B 19/00

(52) U.S. Cl. ..... 392/380; 34/90; 392/383; 392/381; 392/382

(58) Field of Search ..... 392/380–385, 392/409, 410; 34/90, 91, 96, 97; 607/96, 100, 104, 108–111

(56) References Cited

U.S. PATENT DOCUMENTS

| | | | | |
|---|---|---|---|---|
| 1,579,513 A | | 4/1926 | Cameron | |
| 1,660,802 A | | 2/1928 | Martin | |
| 2,267,547 A | | 12/1941 | Zimmerman | |
| 2,856,700 A | | 10/1958 | Wales | |
| 2,913,833 A | * | 11/1959 | Glintz | |
| 3,378,009 A | * | 4/1968 | Peplin | 128/266 |
| 3,610,238 A | * | 10/1971 | Rich, Jr. | 128/184 |
| 3,836,750 A | | 9/1974 | Caruso | |
| 3,866,612 A | * | 2/1975 | Buker | 128/401 |
| 4,433,492 A | | 2/1984 | Santa Lucia | 34/99 |
| 4,596,565 A | | 6/1986 | Ruderian | 604/291 |
| 5,099,587 A | * | 3/1992 | Jarosch | 34/202 |
| 5,189,751 A | * | 3/1993 | Giuliani et al. | 15/22.1 |
| 5,263,218 A | * | 11/1993 | Giuliani et al. | 15/22.1 |
| 5,394,620 A | * | 3/1995 | Chimera | 34/97 |

FOREIGN PATENT DOCUMENTS

| | | |
|---|---|---|
| DE | 2637484 | 4/1978 |
| DE | 29803925 | 6/1998 |
| DE | 19744085 | 6/1999 |
| JP | 52-66061 | 1/1977 |

* cited by examiner

*Primary Examiner*—John A. Jeffery
(74) *Attorney, Agent, or Firm*—Gifford, Krass, Groh, Sprinkle, Anderson & Citkowski, P.C.

(57) ABSTRACT

A forced air dryer designed to dry an infant's bottom during the diaper changing process comprises a housing having an end piece designed to reduce skin abrasion, skin heating, and air flow blockage. In one embodiment, the device is powered by a rechargeable electric battery. In another embodiment, the invention is associated with a diaper changing table.

3 Claims, 7 Drawing Sheets

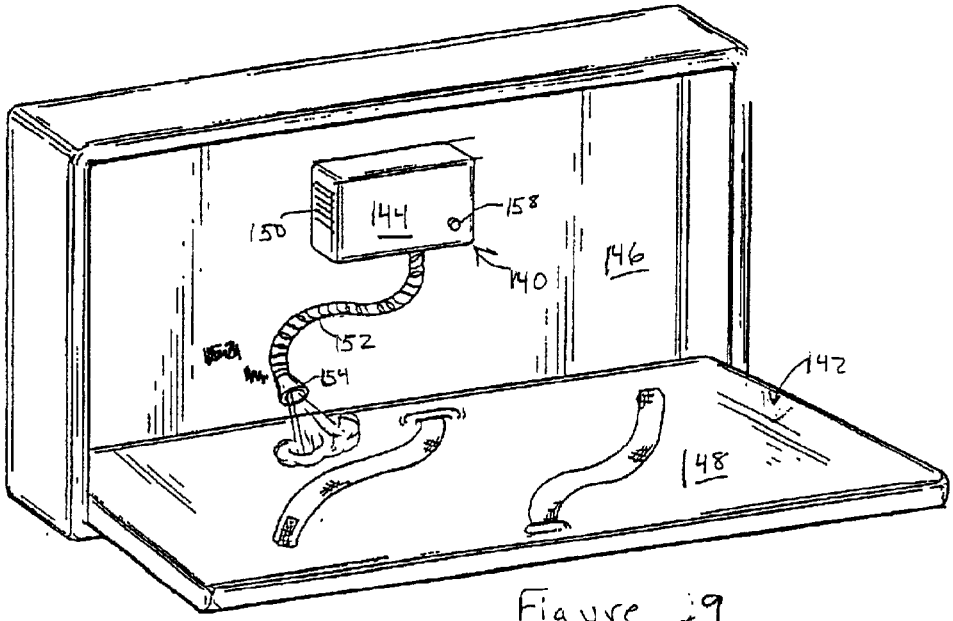
Figure 9
Figure 10
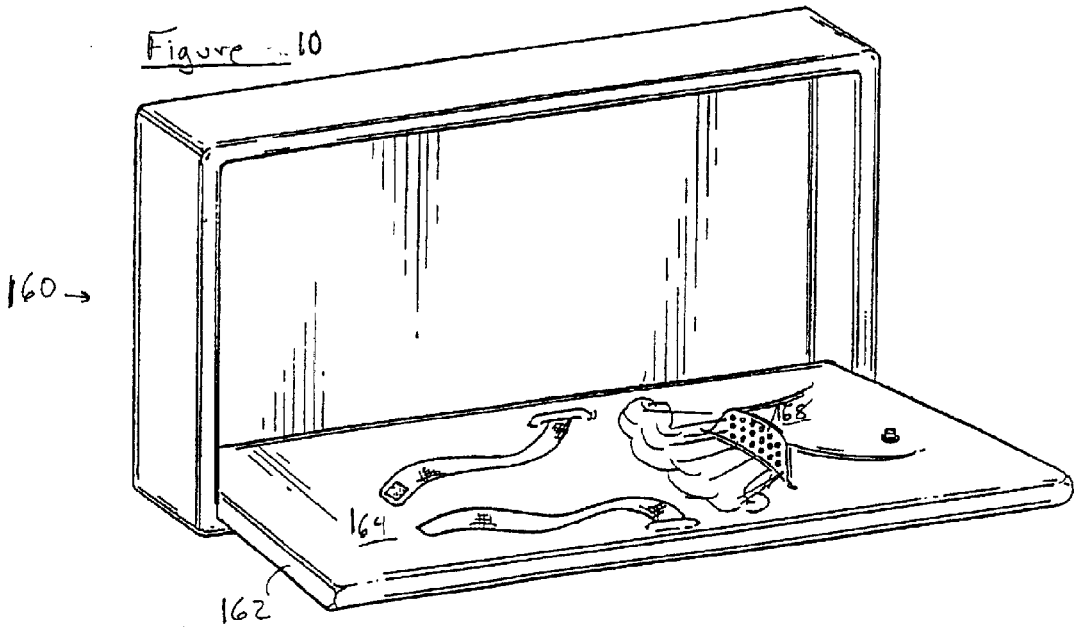

FORCED AIR DRYER FOR INFANT'S BOTTOM

RELATED APPLICATIONS

This application is a continuation of U.S. patent application Ser. No. 09/617,641, filed Jul. 17, 2000, abandoned, which claims the priority dates of provisional applications No. 60/144,577 (filing date Jul. 19, 1999), Ser. No. 60/173,529 (filing date Dec. 29, 1999), and Ser. No. 60/159,667 (filing date Oct. 15, 1999), which are hereby incorporated by reference.

FIELD OF THE INVENTION

The present invention relates generally to forced air dryers and, more specifically, to a forced air dryer designed to dry an infant's bottom during the diaper changing process.

BACKGROUND OF THE INVENTION

During the first few years of life, human infants typically wear diapers to retain or absorb solid and liquid waste. Once a caregiver notices that a diaper has become soiled, the soiled diaper is removed, the infant's bottom and crotch region is cleaned, and a new, unsoiled, diaper is placed onto the infant. (In this specification, the term "infant's bottom" is used for convenience to describe the buttock area, crotch, and surrounding regions of a baby; areas which may be covered by a diaper). To clean the infant, caregivers often use disposable, pre-moistened towelettes. The soiled skin area is wiped with the towelette to remove waste residue prior to placing the new diaper on the infant.

Infants often suffer from skin irritation, commonly known as diaper rash, on the infant's bottom attributable in part to the moist environment. In order to minimize diaper rash, it is desirable to dry the infant's bottom prior to placing a clean diaper on the infant. Using a dry towel to remove moisture from the infant may irritate sensitive skin. It is preferable to air dry the skin. However, it is often impossible to allow enough time for the infant's bottom to dry completely if the process depends on natural, unassisted, evaporation. Infants are often unwilling to lie still during the diaper change process, and extending the time required to allow for natural evaporation may be difficult if the infant continually tries to move. Also, the caregiver may only have limited time during which to complete the diaper change process so that they can return their attention to other children or other tasks. In light of the above, there is a need for an apparatus to assist in the drying of an infant's bottom during the diaper change process. It is preferred that such a device air-dry the region more quickly than would be possible through natural, unassisted, evaporation. However, it is obviously also important that such a device be designed such that it is easy to use and does not risk injury to the infant.

In U.S. Pat. No. 5,394,620, Chimera describes a hand-held body drier with selective attachments. However, this patent does not describe the use of resilient end surfaces adapted for contact with the body to minimize abrasion of sensitive skin. Also, the attachments described do not have means for relieving pressure if the air outlet is blocked. In one embodiment described in U.S. Pat. No. 5,394,620, an attachment having a brush is described. However, a brush is difficult to clean, and may abrade the skin.

SUMMARY OF THE INVENTION

The present invention solves the problems (such as diaper rash) caused by the moist skin of a baby after a diaper changing process. The invention incorporates essentially an air blower mounted within a housing having a resilient end surface material designed to minimize skin abrasion. In other embodiments, the air blower is associated with a diaper changing table.

BRIEF DESCRIPTION OF THE DRAWINGS

FIG. 9 is a perspective view of another embodiment of a forced air dryer according to the present invention, associated with a diaper changing table;

FIG. 10 is a perspective view of another embodiment of a forced air dryer according to the present invention, that is integral with a diaper changing table.

DETAILED DESCRIPTION

Figure 1:
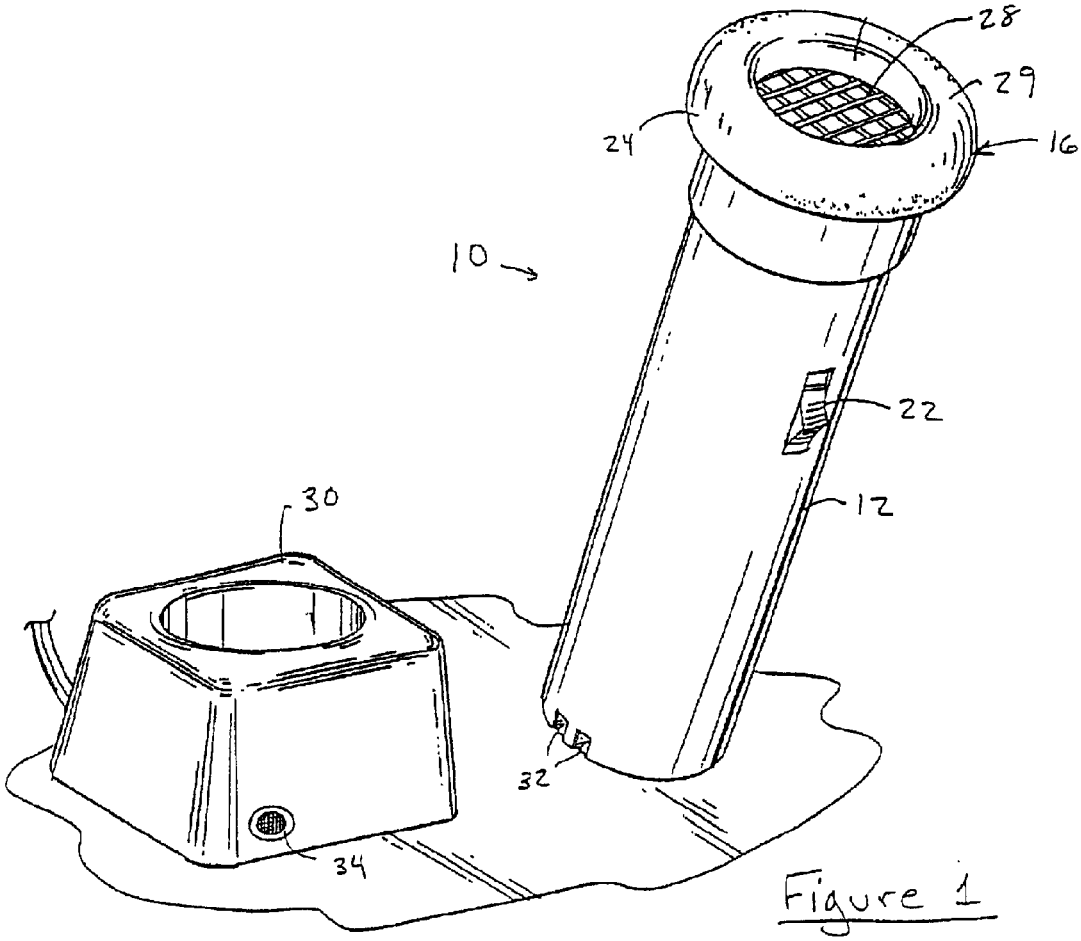
FIG. 1 is a perspective view of a hand-held forced air dryer forming a preferred embodiment of the invention along with an associated charging unit.
Figure 2:
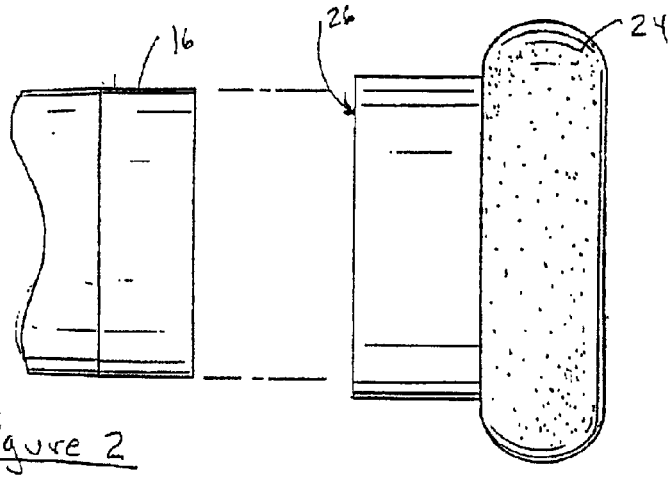
FIG. 2 is a detailed side view of the end of the dryer of FIG. 1 showing the detachability of the end piece.

Referring to FIGS. 1 and 2, a forced air dryer according to the present invention is generally shown at 10. The dryer 10 is constructed similar to a hair dryer in that it has an outer housing 12 that may be gripped by a user. One end of the housing forms an air outlet duct 16, for example in the shape of a nozzle. The housing 12 contains a blower, for example an electric fan, which draws air into the housing through at least one air inlet hole in the housing, and directs the air out through outlet duct 16. The electric fan is connected to an electric power source, e.g. a rechargeable battery, other battery, electric mains connection, etc. The inlet holes may be formed near one end of the housing 12 opposite the outlet duct 16, the location is not important as long as the blower is able to draw air in through the air inlet holes and blow it out of the outlet. A switch 22 is included on the housing 12 for turning the dryer 10 on and off. The dryer 10 also includes an end piece 24, which is fitted to the end of the outlet duct 16. The housing may be generally in the form of a tube, having an end associated with the end-piece, and a second end adapted for gripping by the human hand. A laterally attached handle may also be used.

One configuration of the end piece 24 is illustrated in FIGS. 1 and 2. The end piece 24 has an outermost end, which may contact the infant during drying, and a rearmost end, which is fitted to the outlet duct 16. Preferably, the end piece 24 is (in whole or in part) deformable, e.g. being constructed of a resilient material such as a plastic. The end piece 24 has an opening 26 in its rearmost end so that it may fit over the end of the outlet duct 16. The shape of the opening preferably matches that of the outlet duct. Its outermost end has plurality of air outlet holes 28 for allowing air to flow out from the duct 16 and through the end piece. As shown, the outlet holes 28 may be recessed from the outermost end of the end piece 24 so that the holes 28 are surrounded by a protruding soft ridge 29. Preferably, the protruding ridge around the air outlet duct is formed of a resilient material, such as soft plastic, or a foam such as closed cell foam polyurethane. Within the context of this specification, the term resilient material refers to one which is capable of being deformed by the forces encountered in typical use, e.g. for baby drying a force of 1 lb or less, so that the baby is not hurt (e.g. abraded) during the drying process. Materials used for the end piece might include polyethylene, synthetic or natural rubbers, elastomers, medium density polyethylenes, polypropylene, etc. Foamed or porous materials may also be used, possibly covered by a fabric layer or a smooth film. The surface of the outermost end of the end piece is preferably smooth, with no sharp edges, so as to reduce abrasion or irritation of skin if contact is made during the drying process. This surface may be infused with lubricant, such as an oil. The surface layer of the outermost end of the end-piece may be made using a low friction material (e.g. a fluorinated polymer) so as to reduce abrasion (e.g. a smooth plastic surface), or formed using a soft, yielding material (in the context of human touch), e.g. a gel (such as silicone gel) contained within a plastic film.

In an alternative embodiment, the outlet duct 16 of the housing 12 is formed from plurality of air outlet holes in the housing, or a mesh or grid covers the outlet duct 16, and the end piece fits over the output duct providing a protruding soft ridge around the outlet duct, with the end piece having at least one outlet hole. In a preferred embodiment, the protruding ridge formed by the end piece 24 around the outlet duct 16 is formed by a soft, resilient material, such as soft plastic, as discussed above.

The nature of the mechanical connection between the end piece and the housing is not critical to the invention. The end piece 16 may be permanently attached to the housing 12 in a unitary structure, but preferably the end piece is removable. Preferably, the end piece 24 pushes over the outlet duct 16 and is secured by friction (e.g. using a tapered outlet), but other configurations are possible, e.g. screw connections, clips, snaps, etc. A hand-grip may also be formed on the housing, preferably near the end opposite the air outlet duct, e.g. by molding the housing with ridges and/or depressions, by adding a sleeve around the housing to improve grip, or by some other method.

In use, a parent or caregiver uses the dryer 10 to dry the infant's bottom prior to placing a clean diaper on the infant. The old soiled diaper is removed from the infant, the infant's bottom is cleaned in the traditional manner, and the dryer 10 is then used to dry the infant's bottom. The dryer 10 is preferably battery powered for safety reasons. The parent or caregiver grips the blower 10 by the housing 12 and turns it on using the switch 22. A grip, touch, or tilt-activated switch may also be used. A flow of air is then directed out of the outlet duct 16, and then out through the end piece 24. This flow of air is directed against the infant to evaporate moisture. If the resilient end 24 comes in contact with the infant, its deformability prevents discomfort or injury. During use, the end piece 24 may become soiled in some manner. For this purpose, it is preferred that the end piece 24 be removable from the outlet duct 16 so that it may be cleaned or disposed of.

Because the dryer 10 is intended for use with infants, it is preferred that only room temperature or slightly heated air be blown out through the outlet duct 16. Therefore, unlike a hair dryer, the dryer 10 does not include high-powered electric heaters. In one embodiment, the dryer 10 includes no heating device so that only room temperature air flows out through the outlet duct 16. In an alternative embodiment, a low power air heater (preferably an electrical air heater) is provided for slightly warming the air flowing out through the outlet duct. These may be formed by heated wires (e.g. nichrome wires). It is preferred that the air be heated only to approximate body temperature or a few degrees warmer. The low heat level also allows the use of batteries to power the device. A temperature sensor may be provided in the outlet duct 16 for monitoring the temperature of the out flowing air and a feedback circuit may be used to control the heating elements. It is also preferred that the air flows out of the dryer 10 at a low rate to be gentle, and that the dryer 10 be quiet. The cradle may alternatively be wall mounted, in which case the cradle may hook on to the side of the housing 12.

As shown in FIG. 1, the dryer 10 preferably is battery powered and rechargeable. For this purpose, a recharge cradle 30 is provided. It is preferred that the hand-held version of the dryer 10 be rechargeable so that it is easier to use and prevents the need for plugging the dryer 10 into a wall socket. As shown, the end of the dryer 10 opposite the outlet duct 16 includes electrical contacts 32. The cradle 30 is shaped so that the end of the dryer can be inserted into the cradle 30. As in known to those of skill in the art, the cradle 30 makes a connection with the contacts 32 when the dryer rests in the cradle 30. In this way, the cradle 30 charges the rechargeable batteries inside the dryer 10. The cradle 30 also preferably includes a charging indicator light 34. The cradle 30 is attached to a wall socket to obtain power.

Figure 3:
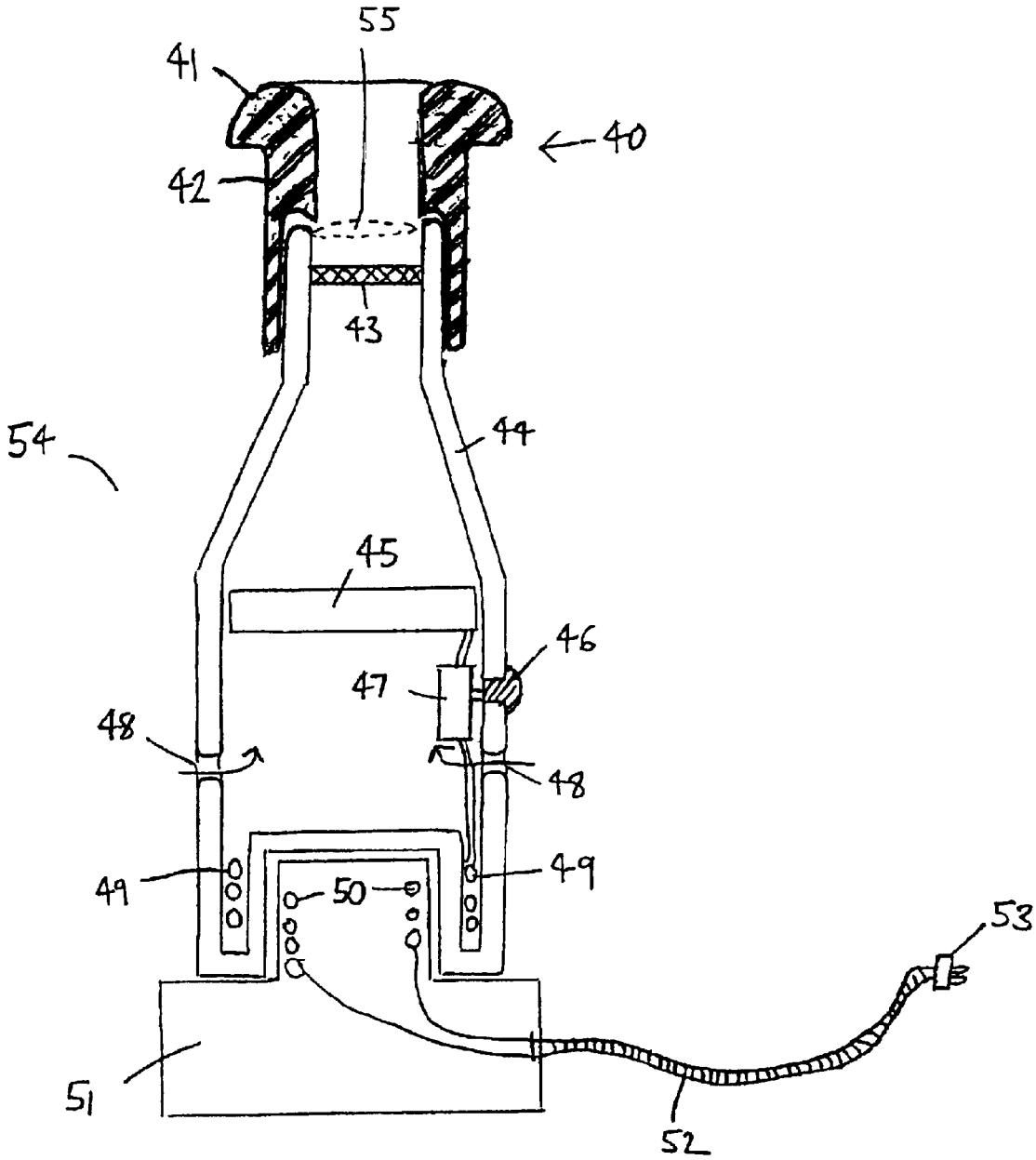
FIG. 3 is a side view of another embodiment of the invention, having inductive charging.

FIG. 3 shows another embodiment of the invention, comprising generally of an air blower 54 and a charging cradle 51. Removable end piece 40 is formed from two parts, a part 41 (e.g. molded plastic) for fitting to the blower housing 44, and a softer part 41 (e.g. foam), bonded together. Housing 44 of the air blower 54 has air inlet holes 48 and an outlet duct 55. Within the housing are an electric fan 45, powered by an electrical system 47. The electrical system 47 comprises a rechargeable battery and electronic control circuitry. An indicator light 46 is illuminated when the battery is charging. The battery is charged inductively using a cradle 51, through the inductive coupling of windings 49 (within blower 54) and 50 (within the cradle 51). Windings 50 are powered via mains electricity via cable 52 and plug 53. A switch (not shown) may be used to turn on and off the fan, alternatively the electrical system 47 may be used to turn on the fan automatically when the air blower 54 is removed from the cradle 51, so that no on-off switch is necessary. Such a device would turn on automatically when removed from its cradle, then turn off automatically when returned to its cradle. A tip (or tilt) switch (not shown) may alternatively be used to turn off the dryer when their orientation of the housing is essentially vertical, i.e. set down on its base or set in a recharging cradle.

Figure 4:
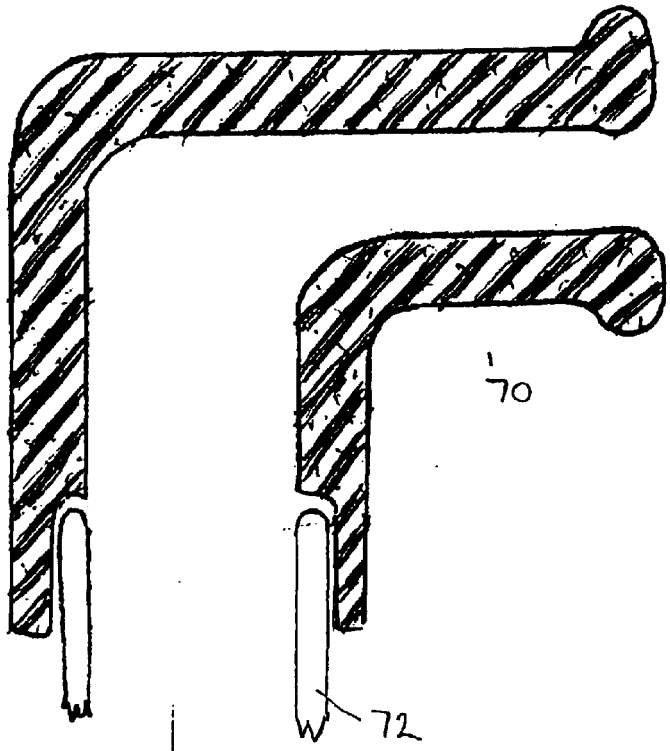
FIG. 4 is a side view of a detachable end piece, which directs air flow through some angle.
Figure 5:
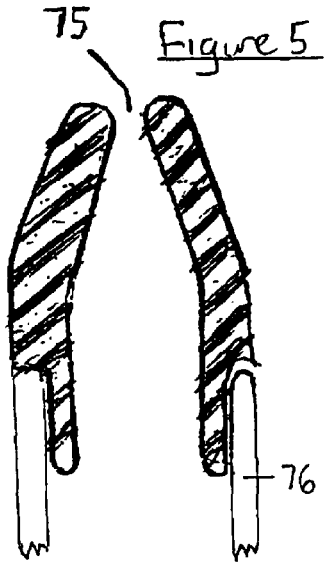
FIG. 5 is a side view of a detachable end piece, which directs air through a constricted aperture.

Referring back to the embodiment shown in FIGS. 1 and 2, different configurations of the end piece are possible. For example, FIG. 4 shows an end piece 70 in which air is blown in a direction at an angle (i.e. not parallel) to the air flow into the end-piece. Alternatively, the outlet duct 72 on which the end piece is mounted may configured to blow air out at an angle to the main axis of the housing. FIG. 5 shows an end piece 74 with a narrow opening 75 for air to pass through, e.g. for drying of narrow crevices, mounted on an outlet duct 76. The dryer may be supplied with an assortment of end pieces, each with slightly different effects on air flow, or with added functionality (e.g. fluid absorption, lotion dispensing, brushing, wiping, etc.).

Figure 6:
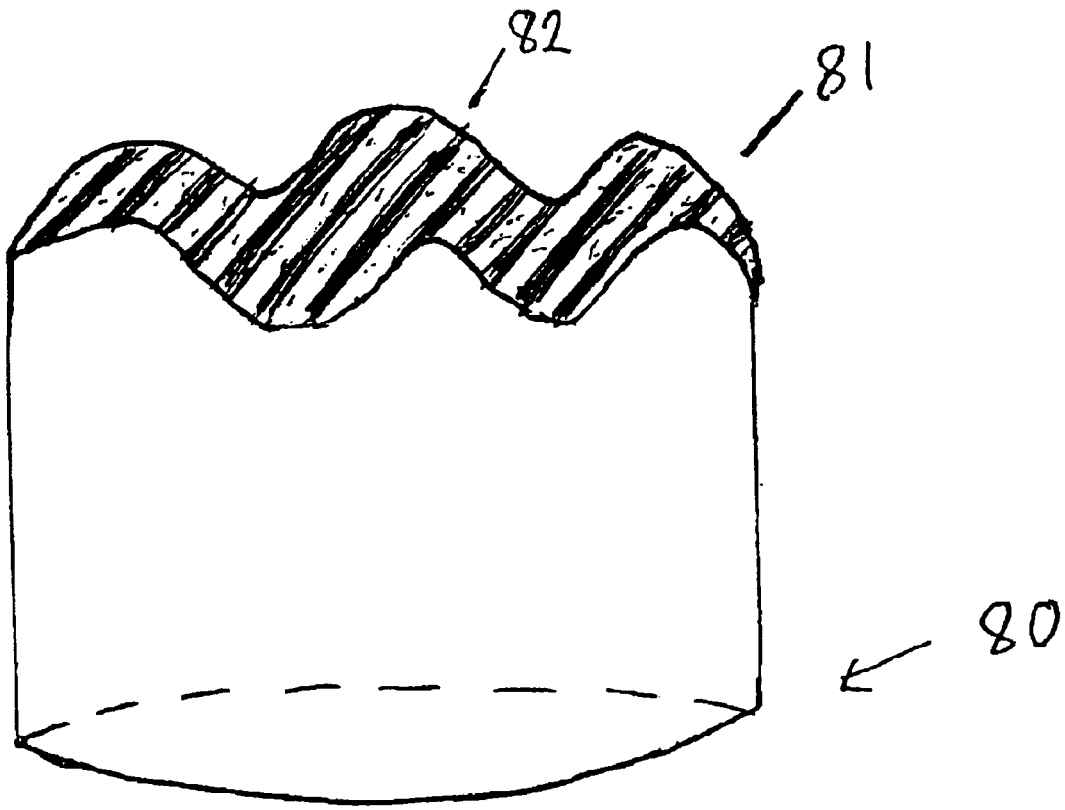
FIG. 6 shows a detachable end piece with an undulating end surface.
Figure 7:
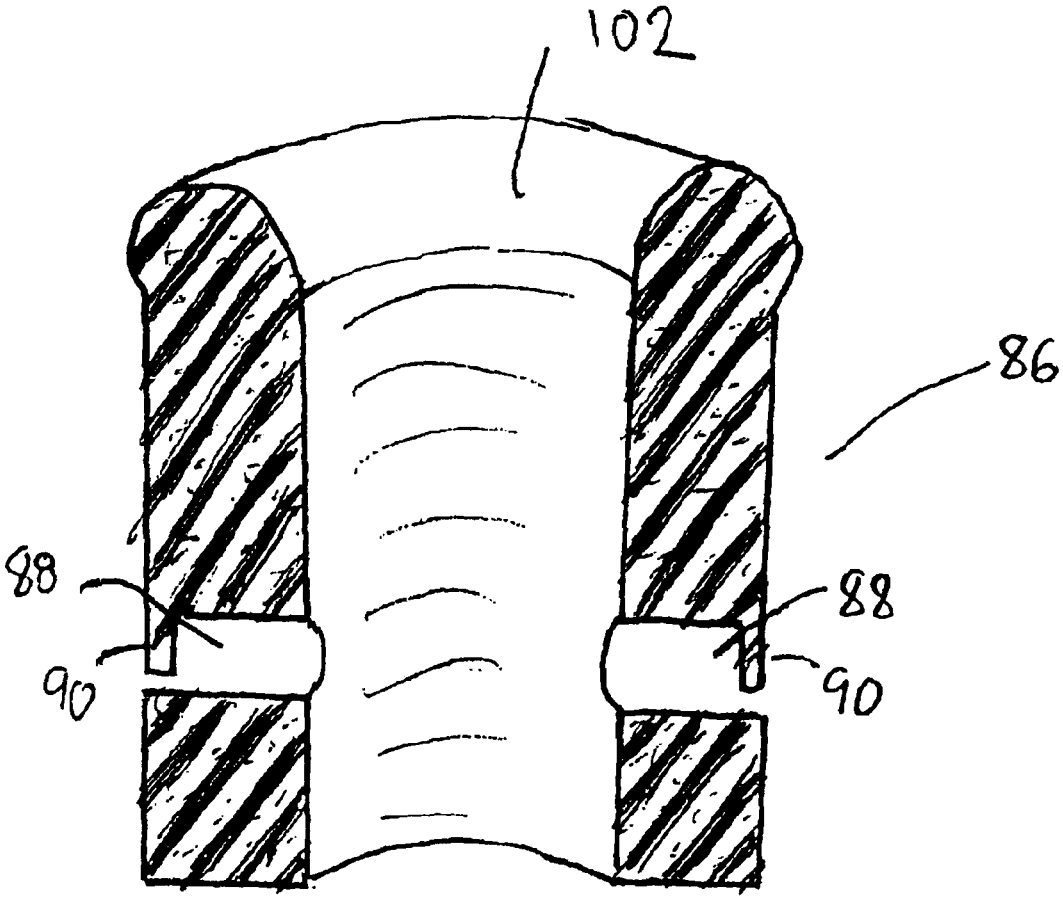
FIG. 7 shows a side view of a detachable end piece with lateral holes for preventing air flow blockage.
Figure 8:
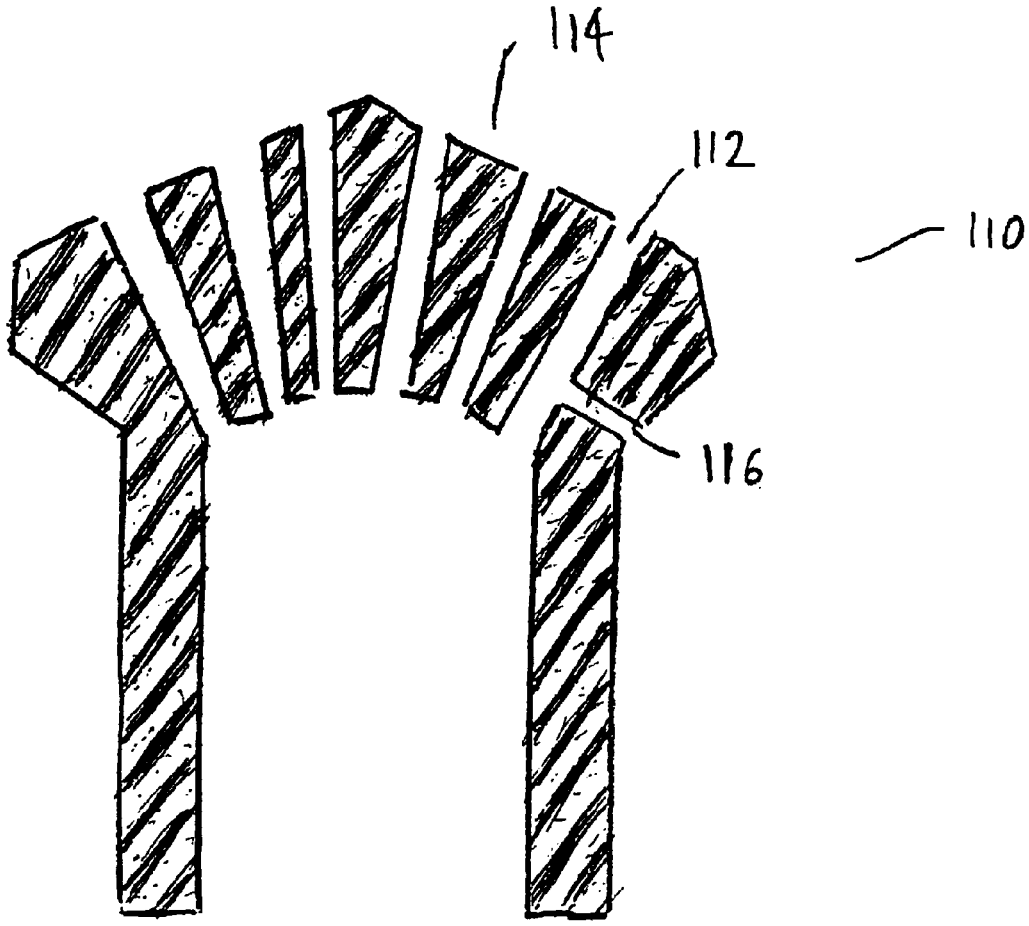
FIG. 8 shows a side view of a detachable end piece with a contoured end surface, a plurality of air outlet holes, and additional hole(s) for preventing air flow blockage.

It is preferred that air flow out of the housing not be blocked completely if the end piece is placed directly up against an object, such as some part of a baby. Blocked air flow may cause overheating of the air blower. Conventional hair-driers possess a thermostat, which turn off the device if the air outlet is blocked. A number of methods may be used to avoid air flow blockage; these means for venting air are described below. For example, additional holes may be placed in the housing, near the outlet duct. The connection between the housing and the end piece may be non-airtight. The end piece may be configured to allow air flow laterally to the walls of the end piece. For example, the end piece may be made in whole or in part using a porous material, such as foam rubber, which allows air to diffuse through it. The end piece may be shaped to reduce the possibility of air flow blockage, having e.g. a curved, undulated, or castellated outermost end. FIG. 6 illustrates an end piece 80 having an outermost end 81 with an undulated profile 82 to help prevent a seal being made between that end and a smooth surface. FIG. 7 illustrates an end piece 86 having additional lateral holes 88 to allow air to flow out if the outermost end is blocked. These holes are normally closed, but flaps 90 are opened by air pressure if the outermost end 102 of the end piece is blocked. Other methods of venting excess pressure include lateral holes with constrictions that are forced open by an increase in air pressure. In this context, a lateral hole is one enabling air flow at an angle to the main flow. The lateral holes convey a minor fraction of the total air flow, unless the main air outlet at the outermost end is blocked. FIG. 8 illustrates and end piece 110 with a plurality of holes 112 in a shaped outermost end 114, with holes such as 116 venting pressure if the end 114 is blocked. Other configurations of the end piece are possible.

The housing (or end piece) may additionally contain, or otherwise have associated with it, other functionality besides blowing of air. For example, the housing may contain a radiation source, such as a lamp, for illuminating the infant's bottom and/or providing gentle heating. The lamp may be an incandescent lamp, which provides both light and a degree of heating, a visible-emitting light emitting diode, an IR-emitting light emitting diode for heating, or a combination of radiation sources. The housing may also contain a dispenser for one or more substances, e.g. vapors of volatile liquids (e.g. scents), powders (e.g. anti-irritation powders, medicated powders), aerosols, mists, etc.; for example a disinfectant dispenser, soothing medication dispenser, baby oil dispenser, etc. The housing and/or end piece may contain an air filter, for removing particles, odors, or other contaminants from the blown air, which may be useful in some applications of the present invention.

Referring back to the device shown in FIGS. 1 and 2, the power requirements of an internal rechargeable battery will be reduced by including a heating block within the housing which is heated to a preset value while the device is within the recharge cradle 30. For example, a ceramic block may be electrically heated to a temperature just above body temperature while the device is in the cradle 30. After removing the device from the cradle, electrical heat is disconnected from the block, and air flowing over or through the block is warmed for a time related to the heat capacity of the block. Alternatively, continued heating of the block, or heating air by another method, may be provided using battery power. In use, preferably, the pre-heating of the block is initiated a few minutes or so before the device is used, perhaps at the point the old diaper is to be removed, and may be cut off automatically if the device is not used within a specified period.

The blower may also be reversible, so that the device may be used as a vacuum cleaner. Infants often have the tendency to deposit food from their mouths (or surrounding regions) onto the clothing of the person holding them. The direction of the fan may be reversed in order to remove such food particles. In this embodiment, the housing or end piece should contain a trap, e.g. a removable screen, to catch such items removed.

The device shown in FIGS. 1 and 2 may also be used in the field of wound treatment and management. As known to those of skill in the medical arts, it is desirable to dry some types of wounds in order to encourage healing. Air flow over some types of wounds is also beneficial. The present invention may be used with these types of wounds to provide a gentle flow of room temperature or warm air. Such treatment may also be beneficial when a bandage or wound dressing is changed. Prior to replacing the bandage or dressing, the present invention may be used to warm and/or dry the affected area. For such applications, the device may also comprise dispensers for anti-bacterial or anti-viral agents, which may be brushed, blown, sprayed, wiped, or otherwise dispensed onto the wound area, or other sterilization means such as a UV lamp.

The present invention may also be used for the gentle drying or heating of other heat-sensitive objects, e.g. fabric-based items (e.g. clothes, carpets, furniture, curtains, etc.), animals (pets, farm animals, etc.), animal products (e.g. eggs, fur, hides, etc.), other living or once-living things (e.g. plants, microorganisms, salad vegetables (e.g. lettuce, spinach), etc.), sensitive equipment of any kind (e.g. electronic equipment, computers, optics), crystals, mineral specimens, semiconductor wafers, fossils, archeological finds, works of art and other valuables, gels, sol-gels, films, membranes, avionics, etc. The end piece, in particular its outermost surface, is chosen to present a minimal contact hazard for the object to be dried or warmed, e.g. non-particulating and soft for drying of optical instruments. The present invention may also be used for personal drying of an adult, e.g. as a supplement or alternative to toweling of sensitive areas. It may also be used as a low-power hairdryer, relatively low powered compared to conventional devices, but useful to people with sensitive scalps, easily heat-damaged hair, or very short hair.

The dryer may have a power source other than a battery, for example a hand crank (e.g. a rotary mechanism powered by a squeezing hand), or be mechanically powered by potential energy e.g. using a spring.

Referring to FIG. 9, a wall mounted version of a dryer according to the present invention is generally shown at 140. Many public facilities now provide fold-down diaper changing tables 142 for use by their patrons. The fold-down changing table 142 includes a wall-mounted portion 146 and a fold-down table 148 providing a flat surface on which the infant is supported for changing a diaper. The wall-mounted version of the dryer 140 is configured for use with such an arrangement. It includes a wall-mounted housing 144 with an air inlet grill 150 and an air directing mechanism, i.e. outlet tube 152. The air directing mechanism may be a flexible tube for maximum ease of manual control of air flow direction, or may be a semi-flexible tube which can be manipulated to a shape to direct air towards a baby and then retain approximately that shape after manipulation. In use, the blower draws air in through the inlet grill 150 and pushes it out through the outlet tube 152. The outlet tube 152 may be extendable and retractable out of the housing 144 so that it may be held in position to dry an infant on the table 148. The outlet tube 152 preferably includes an end piece 154, preferably formed of a deformable, resilient material, as with the prior embodiments. The end piece 152 preferably protrudes around the directed air outlet of tube 152. A start button 158 or other type of control device is provided.

Referring to FIG. 10, a diaper-changing table incorporating a further embodiment of a forced air dryer according to the present invention is generally shown at 160. The upper surface 164 of the table 162 may be contoured and/or padded to increase the comfort of an infant. According to the present invention, the table 160 includes a forced air dryer (equivalently a forced air blower) system which includes a blower which forces air out through an air outlet vent 168. As shown, the air outlet vent 168 is integral with the top surface 164 of the table 160 in a position adjacent where the bottom and crotch area of an infant reclining on the top surface 164 would be. The vent 168 has a plurality of air outlet holes which direct air against the infant's bottom. As shown, the vent 168 is shaped so as to partially conform to the shape of the bottom of an infant. The vent 168 is preferably shaped so as not to have any sharp edges and may also be padded for comfort and safety. A replaceable vent cover may also be provided so that a sanitary surface may always be provided. An air heater maybe included in this configuration. Several air outlet vents may be also be provided for drying the whole body of the baby. Air may also be blown through a foam pad used support the baby.

As will be clear to one of skill in the art, other embodiments are possible without departing from the spirit or teaching of the present invention. For example, a dryer may be provided that is a self-contained box, which may be placed upon a diaper changing table. Alternatively, the box would serve as the diaper changing table, resting on any convenient surface. The box would include a blower and an outlet side that will direct air against the bottom of an infant. Such a box would preferably be padded and have rounded edges so as to prevent injury. This embodiment of the dryer could be battery powered or plug in and include appropriate safety measures. With all embodiments of the present invention, it is preferred that the surfaces and components be cleanable in case it becomes soiled during the diaper change process. Other variations on the present invention will be clear to those of skill in the art. Therefore, the present disclosure and drawings should be interpreted broadly.

I claim:

1. A forced air dryer for drying an infant's bottom as part of a diaper changing process, comprising:

a housing having an air inlet and an air outlet;

an electric fan mounted within the housing operative to draw air into the housing through the inlet and force air out of the outlet;

an air heater mounted within the housing;

a rechargeable battery supported in the housing and operative to power the electric fan and the air heater;

a cylindrical tubular foam plastic end piece, connected to the air outlet so as to receive air from the outlet;

an air passage formed through the end piece, laterally to the axis of the cylinder, operative to vent outlet air to the atmosphere at such time as the tubular outlet of the end piece is blocked;

a cradle for removably supporting said housing; and a source of electric power supported in the cradle for charging the battery.

2. The dryer of claim 1, further comprising a lamp mechanically associated with the housing, so as to illuminate a region to which air is directed.

3. The dryer of claim 1, in which the end piece is detachable.

* * * * *